US005867057A

United States Patent [19]

Hsu et al.

[11] Patent Number: 5,867,057

[45] Date of Patent: Feb. 2, 1999

[54] APPARATUS AND METHOD FOR GENERATING BIAS VOLTAGES FOR LIQUID CRYSTAL DISPLAY

[75] Inventors: Jerry Hsu, Tainan; Wesley Jehng, Hsinchu, both of Taiwan

[73] Assignee: United Microelectronics Corp., Hsinchu, Taiwan

[21] Appl. No.: 630,256

[22] Filed: Apr. 10, 1996

[51] Int. Cl.[6] ..... G05F 1/10

[52] U.S. Cl. ..... 327/544; 327/538; 307/15; 307/37; 307/38

[58] Field of Search ..... 345/211, 212; 307/15, 16, 32, 36, 37, 38, 39; 327/174, 415, 538, 544

[56] References Cited

U.S. PATENT DOCUMENTS

| | | | |
|---|---|---|---|
| 4,012,688 | 3/1977 | Blackburn et al. | 323/74 |
| 5,339,021 | 8/1994 | Thomson | 323/354 |
| 5,343,221 | 8/1994 | Arakawa et al. | 345/211 |
| 5,416,438 | 5/1995 | Shibata | 327/552 |
| 5,532,718 | 7/1996 | Ishimuru | 345/211 |

FOREIGN PATENT DOCUMENTS

| | | |
|---|---|---|
| 0479304 | 4/1992 | European Pat. Off. . |
| 0642112 | 3/1995 | European Pat. Off. . |

*Primary Examiner*—Timothy P. Callahan
*Assistant Examiner*—Jung Ho Kim
*Attorney, Agent, or Firm*—Ostrolenk, Faber, Gerb & Soffen, LLP

[57] ABSTRACT

An apparatus and method for generating bias voltages for an LCD driver. A voltage divider including serially connected resistors of a first resistance is arranged to form a DC current path having nodes. The voltage of each node serves as a bias voltage to the LCD driver for actuating the LCD driver to generate LCD driving signals. A signal generator is used to generate a switching signal in synchronism with the LCD driving signals. A switching circuit including switches is arranged so that when the switches are closed, the resistance between two adjacent nodes has a small value, so as to provide large driving currents to the LCD driver, and when the switches are open, the resistance has a large value, so as to reduce the amount of leakage current through the DC current path.

10 Claims, 8 Drawing Sheets

APPARATUS AND METHOD FOR GENERATING BIAS VOLTAGES FOR LIQUID CRYSTAL DISPLAY

BACKGROUND OF THE INVENTION

1. Field of the Invention

The invention relates to a liquid crystal display (LCD), and more particularly, to an apparatus and method for generating bias voltages for an LCD driver.

2. Description of Background Art

Liquid crystal displays (LCDs) are digital displays widely used in digital watches, calculators, handheld game machines, and various other electronic appliances. The circuit structure of a typical LCD device is shown in FIG. 1, in which an LCD driver 10 in conjunction with a voltage divider 20 are used to drive an LCD panel 30. In practice, the LCD driver 10 and the voltage divider 20 are implemented in an integrated circuit (IC) as indicated by the dashed box 1. The voltage divider 20 consists of a number of resistors R that divide an external voltage Vcc into bias voltages $V_a$, $V_b$, $V_c$, $V_d$, and $V_e$. These bias voltages are applied to and drive the LCD driver 10 to generate a plurality of LCD driving signals, including common signals, via the COM1–COM8 lines and segment signals via the SEG1–SEG40 lines.

In the voltage divider 20, the plurality of resistors R constitute a DC current path through which a DC current $I_d$ flows. These resistors are provided with high resistances, such as 100 kΩ or 200 kΩ so as to minimize the current $I_d$ flowing through the DC current path. A drawback to the use of high resistance resistors is that the resulting driving current used to actuate the LCD driver for switching of the LCD driving signals may be insufficient. To cope with this problem, a conventional method is to provide a corresponding number of capacitors C connected externally via I/O pins on the IC 1 to the voltage divider 20. These capacitors C are used for voltage stabilization of the circuit so as to supply sufficient actuating current $I_t$ to the LCD driver for switching of the LCD driving signals.

ICs based on the foregoing circuit architecture for generating bias voltages include MSM5238GS, MSM5259GS, and MSM5278 which are manufactured by the OKI Semiconductor Corporation. However, providing the externally connected capacitors has two drawbacks. First, for low-cost LCD handheld game machines, the provision of these externally connected capacitors and the corresponding I/O pins significantly increases manufacturing cost; and second, the increased number of I/O pins on the IC would cause the size of the chip to be larger than it would be otherwise.

Two methods have been used to eliminate the foregoing two drawbacks. The first method is to avoid using the capacitors and reduce the resistance values of the resistors R so as to provide a larger DC current $I_d$. However, this causes a large leakage current. For example, assuming in the circuit of FIG. 1 that R=100 kΩ and Vcc=5 volts, then $I_d$=5/(100 k×5)=10 μA. However, if R is reduced to 15 kΩ, then $I_d$=5 V/(15 kΩ×5)=67 μA. Since the IC needs only a small amount of current for operation, such a large current of 67 μA would cause much of the electrical power to be wasted. The second method is to provide built-in capacitors in the IC. However, this increases the area of the chip and such capacitors would be very low in capacitance, several orders from the desired level.

SUMMARY OF THE INVENTION

It is therefore an object of the invention to provide a method and apparatus for generating bias voltages for an LCD driver which require no externally connected capacitors to dynamically supply sufficient actuating currents to the LCD driver.

It is another object of the invention to provide a method and apparatus for generating bias voltages for an LCD driver which are capable of supplying sufficient actuating current despite the fact that resistors having high resistance values are used in the voltage divider.

In accordance with the foregoing and other objects of the invention, a new and improved method and apparatus for generating bias voltages for an LCD driver is provided.

An embodiment of the apparatus according to the invention includes a voltage divider including a plurality of serially connected first resistors forming a DC current path having a plurality of nodes, the voltage of each node serving as a bias voltage to the LCD driver to actuate the LCD driver to generate a plurality of LCD driving signals; a signal generator for generating a switching signal in synchronism with the LCD driving signals; and a switching circuit including a plurality of switching units each of which is connected across a corresponding resistor in the voltage divider, each of the switching units being closed to connect a second resistor across the corresponding first resistor when the LCD driving signals are being switched, and each of the switching units otherwise being open.

Another embodiment of the apparatus according to the invention includes a voltage divider including a plurality of serially connected resistors of a first resistance forming a DC current path having a plurality of nodes, the voltage of each node serving as a bias voltage to the LCD driver to actuate the LCD driver to generate a plurality of LCD driving signals; a signal generator for generating a switching signal in synchronism with the LCD driving signals; and a switching circuit including a plurality of transistor switching units each having an internal resistor of a second resistance, each of the transistor switching units being connected across a corresponding resistor in the voltage divider, each of the transistor switching units being closed so as to connect the internal resistor across the corresponding resistor in the voltage divider when the LCD driving signals are being switched, and each of the transistor switching units being otherwise open.

A further embodiment of the apparatus according to the invention includes a voltage divider including a plurality of pairs of serially connected first resistors and second resistors forming a DC current path having a plurality of nodes, the voltage of each node serving as a bias voltage to the LCD driver to actuate the LCD driver to generate a plurality of LCD driving signals; a signal generator for generating a switching signal in synchronism with the LCD driving signals; and a switching circuit consisting of a plurality of switching units each of which is connected across a corresponding second resistor in the voltage divider, each of the switching units being closed to short-circuit the second resistor when the LCD driving signals are being switched, and each of the switching units being open otherwise.

A method according to the invention comprises the following steps: generating a switching signal; applying a voltage to a voltage divider to set a bias voltage at each node of a plurality of nodes of the voltage divider, wherein the voltage divider includes a plurality of serially connected first resistors and wherein each node is located between a corresponding adjacent pair of the first resistors; opening and closing a plurality of serially connected switching units in response to the switching signal, wherein each of the switching units includes a switch and a second resistor and wherein each of the switching units is connected in parallel with a corresponding one of the first resistors; and connecting each of the second resistors in parallel with the corresponding first resistor when the switching units are closed.

Another method according to the invention comprises the following steps: generating a switching signal; applying a voltage to a voltage divider to set a bias voltage at each node of a plurality of nodes of the voltage divider, wherein the voltage divider includes a plurality of serially connected pairs of first and second resistors and a respective node at one end of each of said pairs of first and second resistors; opening and closing a plurality of serially connected switches in response to the switching signal, wherein each of the switches is connected in parallel with a corresponding one of the second resistors; and nullifying the second resistors when the switches are closed.

A further method according to the invention comprises the following steps: generating a switching signal; applying a voltage to a voltage divider to set a bias voltage at each node of a plurality of nodes of the voltage divider, wherein the voltage divider includes a plurality of serially connected divider resistors and wherein each node is located between a corresponding adjacent pair of the divider resistors; opening and closing a plurality of serially connected transistor switching units in response to the switching signal, wherein each of the transistor switching units includes a transistor switch and an internal resistance, and wherein each of said plurality of transistor switching units is connected in parallel with a corresponding one of the divider resistors; and connecting each of the internal resistances in parallel with the corresponding divider resistor when the transistor switches are closed.

In general, a method of operation applicable to the invention includes the following steps: generating a switching signal; applying a voltage to a voltage divider to set a bias voltage at each node of a plurality of nodes of the voltage divider, wherein the voltage divider includes a plurality of serially connected variable resistors and wherein each node is located between a corresponding adjacent pair of the variable resistors; raising and lowering the resistance values of the variable resistors in response to the switching signal to make the bias voltages to deliver(drive) a dynamic current flowing through the voltage divider.

BRIEF DESCRIPTION OF DRAWINGS

The invention can be more fully understood by reading the subsequent detailed description of the preferred embodiments with reference to the accompanying drawings, wherein.

DETAILED DESCRIPTION OF PREFERRED EMBODIMENTS

Figure 1:
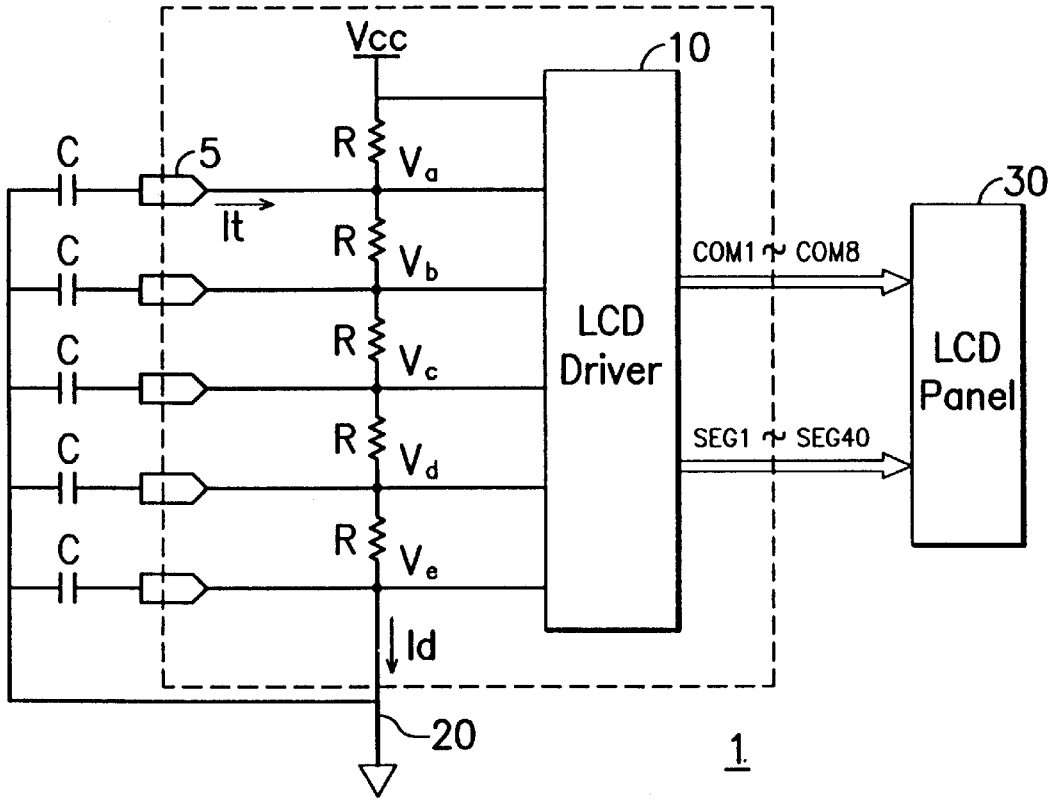
FIG. 1 (PRIOR ART)
FIG. 1 is a schematic block diagram of a conventional circuit configuration for generating bias voltages for driving an LCD driver.
Figure 2:
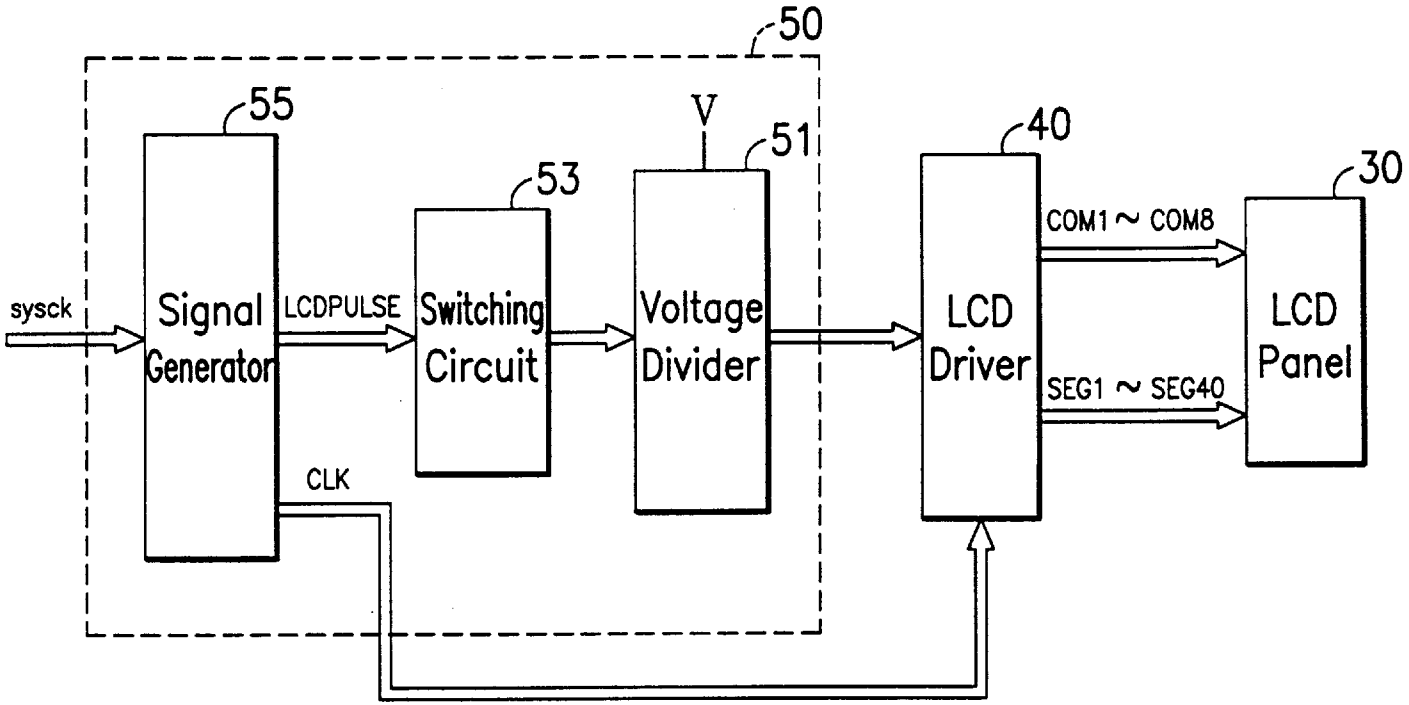
FIG. 2 is a schematic block diagram of a bias voltage generator according to the invention.

Referring to FIG. 2, there is shown a schematic block diagram of a bias voltage generator 50 according to the invention. The bias voltage generator 50 is coupled to an LCD driver 40 used to drive an LCD panel 30. The bias voltage generator 50 comprises a voltage divider 51 coupled to the LCD driver 40, a switching circuit 53 coupled to the voltage divider 51, and a signal generator 55 which receives the system clock signal SYSCK to generate a switching signal LCDPULSE, which is provided to the switching circuit 53. The signal generator also generates a CLK signal to the LCD driver 40. The LCD driver 40 is used to generate a plurality of LCD driving signals, including common signals to be provided via the COM1–COM8 lines and segment signals to be provided via the SEG1–SEG40 lines, to the LCD panel 30. These LCD driving signals COM1–COM8 and SEG1–SEG40 are generated in synchronism under control by the LCDPULSE and CLK signals.

It is an aspect of the invention that the switching circuit 53 is switched so as to lower the resistance between adjacent nodes in the voltage divider 51 in order provide adequate actuating current during switching of the COM1–COM8 and SEG1–SEG40 signals. The switching circuit 53 is switched off at all other times so as to maintain the resistance between adjacent nodes in the voltage divider 51 at a large constant value so as to minimize the current $I_d$ flowing through the circuit path defined by the voltage divider. Various exemplary embodiments for the circuit structure of the bias voltage generator 50 are described below.

First Exemplary Embodiment

Figure 3:
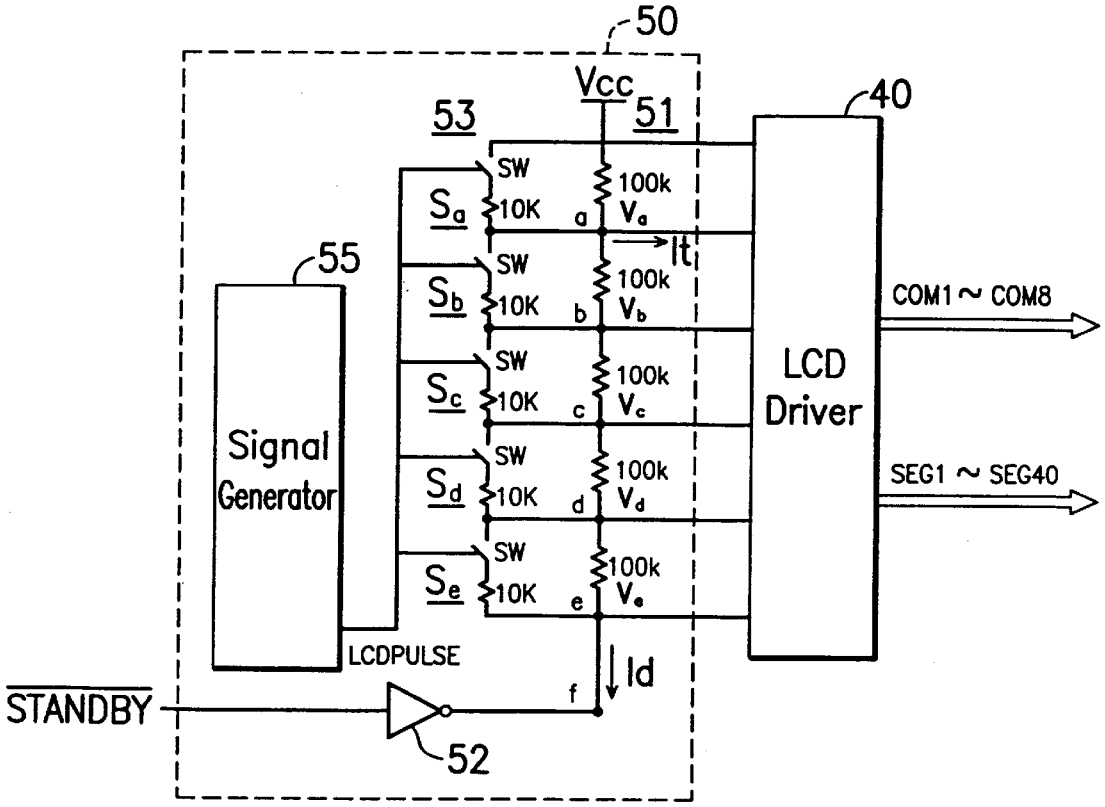
FIG. 3 is a schematic circuit diagram of an embodiment of the bias voltage generator according to the invention.

Referring to FIG. 3, there is shown a schematic circuit diagram of a first exemplary embodiment of the bias voltage generator 50 according to the invention. The voltage divider 51 consists of a plurality of 100 kΩ resistors connected at nodes a, b, c, d, e and coupled to an external voltage source Vcc. This arrangement allows the provision of bias voltages $V_a$, $V_b$, $V_c$, $V_d$, and $V_e$ at the nodes a, b, c, d, e for driving the LCD driver 40. A logic signal $\overline{\text{STANDBY}}$ coupled via an inverter 52 to the node e is used to control the bias voltages $V_a$, $V_b$, $V_c$, $V_d$, and $V_e$ in the manner indicated in the following table:

TABLE

| $\overline{\text{STANDBY}}$ = 1, $V_3$ = logic 0 voltage | $\overline{\text{STANDBY}}$ = 0, $V_e$ = logic 1 voltage |
|---|---|
| $V_a$ = 4/5 Vcc | $V_a$ = Vcc |
| $V_b$ = 3/5 Vcc | $V_b$ = Vcc |
| $V_c$ = 2/5 Vcc | $V_c$ = Vcc |
| $V_d$ = 1/5 Vcc | $V_d$ = Vcc |

The bias voltages $V_a$, $V_b$, $V_c$, $V_d$, and $V_e$ are used to actuate the LCD driver 40 to generate the LCD driving signals COM1–COM8 and SEG1–SEG40.

The switching circuit 53 is composed of a plurality of switching units $S_a$, $S_b$, $S_c$, $S_d$, and $S_e$, each of which consists of a switch SW and a serially connected 10 kΩ resistor. Further, each switching unit is connected in parallel with a corresponding resistor in the voltage divider 51. The switches SW are shown in FIG. 3 in an open position.

The switching signal LCDPULSE generated by the signal generator 55 is used to control switching of the switches SW in the switching circuit 53. When the switching signal LCDPULSE is a logic 1, the switches SW are closed, thereby connecting the 10 kΩ resistors across the 100 kΩ resistors, which effectively reduces the equivalent resistance between two adjacent nodes to about 9.09 kΩ. This allows larger actuating currents $I_t$ to be generated. These actuating currents $I_t$ flow from the nodes a, b, c, d, e to the LCD driver 40 to actuate the LCD driver 40 to generate the LCD driving signals COM1–COM8 and SEG1–SEG40.

During the times the LCD driving signals COM1–COM8 and SEG1–SEG40 are not to be switched, the switching signal LCDPULSE from the signal generator 55 is a logic 0, which causes the switches SW in the switching circuit 53 to be opened. In this circumstance, the nodes a, b, c, d, e are connected only by the 100 kΩ resistors. The resistance between two adjacent nodes is therefore 100 kΩ. When $\overline{\text{STANDBY}}$=1, $V_e$=0 and if Vcc=5 volts, then $I_d$=5 V/500 kΩ=10μA.

The $\overline{\text{STANDBY}}$ signal that controls the voltage $V_e$ ofthe node e is a logic 0 signal when the LCD is in a standby mode and is a logic level 1 otherwise. Thus, when $\overline{\text{STANDBY}}$=0, it is inverted by the inverter 52 to a logic level 1, putting the voltage $V_e$ at Vcc. This allows the current $I_d$ to be forced to null.

Second Exemplary Embodiment

Figure 4A:
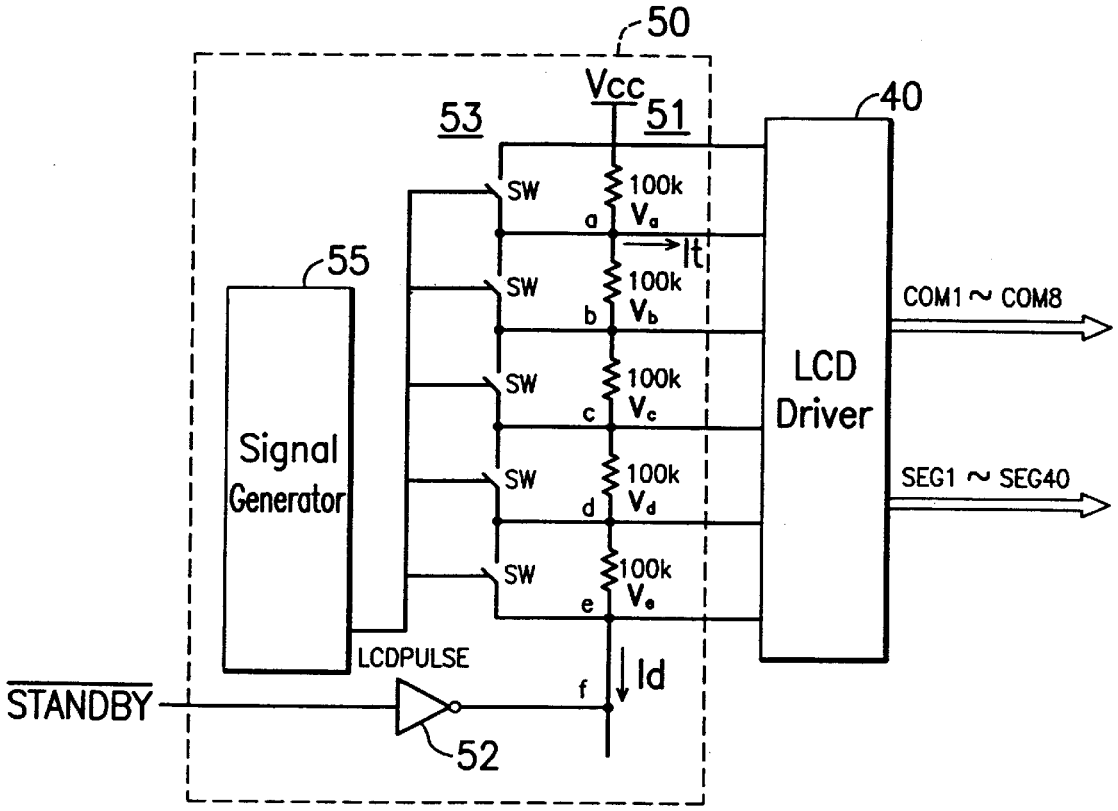
FIG. 4A is a schematic circuit diagram of another embodiment of the bias voltage generator according to the invention.
Figure 4B:
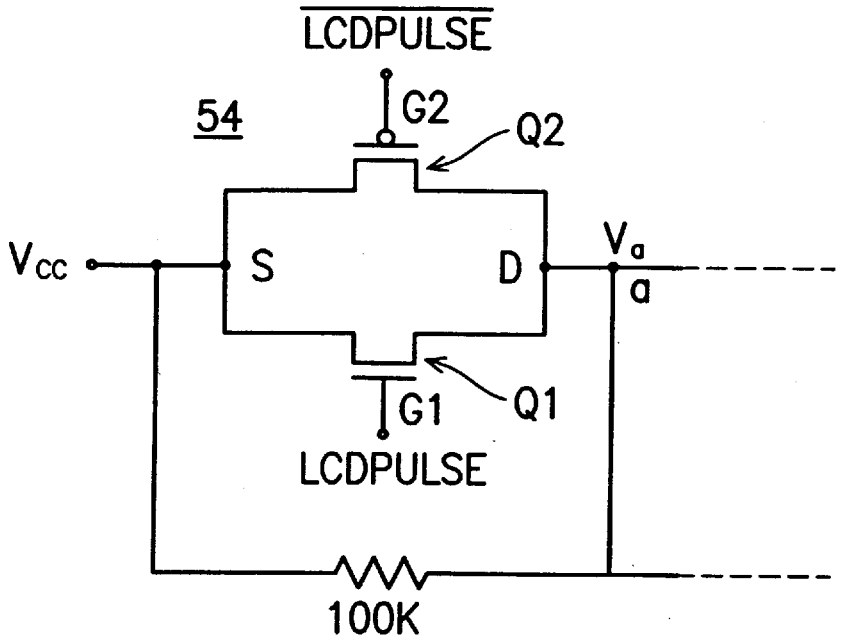
FIG. 4B is a schematic diagram of a switching circuit utilized in the bias voltage generator of FIG. 4A.
Figure 4C:
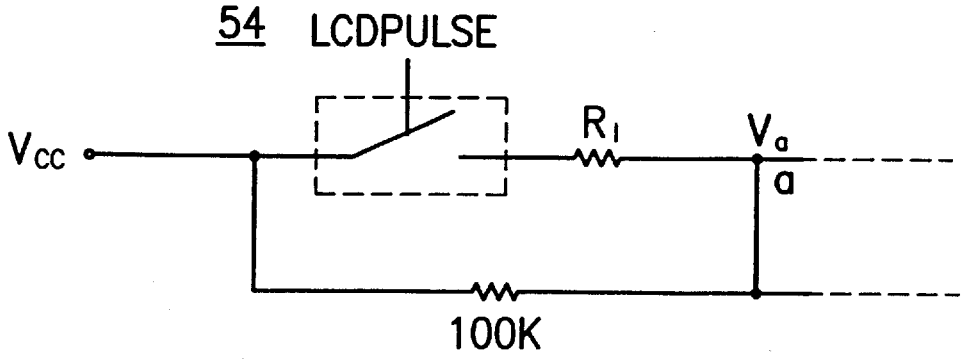
FIG. 4C is an equivalent circuit of the switching circuit of FIG. 4B.

Referring to FIGS. 4A–4C, there are shown diagrams depicting a second exemplary embodiment of the bias voltage generator 50 according to the invention. In this embodiment, elements that are identical in structure and function to those in the first exemplary embodiment are labeled with the same numerals and the description thereof will not be repeated.

The second exemplary embodiment differs from the previous one only in that the switching circuit 53 consists of a plurality of transistor switches SW each having an internal resistance $R_I$ as schematically illustrated in FIG. 4C. Each transistor switch is connected in parallel with a corresponding 100 kΩ resistor in the voltage divider 51.

Referring to FIG. 4B, the transistor switch SW is preferably a long-channel transmission gate 54 comprising an NMOS transistor Q1 having gate GI controlled by LCDPULSE and a PMOS transistor Q2 having gate G2 controlled by $\overline{\text{LCDPULSE}}$. The source S is coupled to Vcc and the drain D is coupled to node a.

When the LCD driving signals are to be switched, the signal generator 55 generates the signal LCDPULSE=1, which causes both the NMOS transistor Q1 and the PMOS transistor Q2 to be turned on. Since there is an equivalent low resistance $R_1$ across the long-channel transmission gate 54, the equivalent resistance between Vcc and node a is less than $R_1$ and the current $I_d$ increases to drive the LCD driver 40.

Otherwise, the signal generator 55 generates the signal LCDPULSE=0, which causes the current path through the NMOS transistor Q1 and PMOS transistor Q2 to be open-circuited. In this circumstance, the equivalent resistance between Vcc and node a is 100 kΩ, thereby causing the current $I_d$ to be low.

Third Exemplary Embodiment

Figure 5:
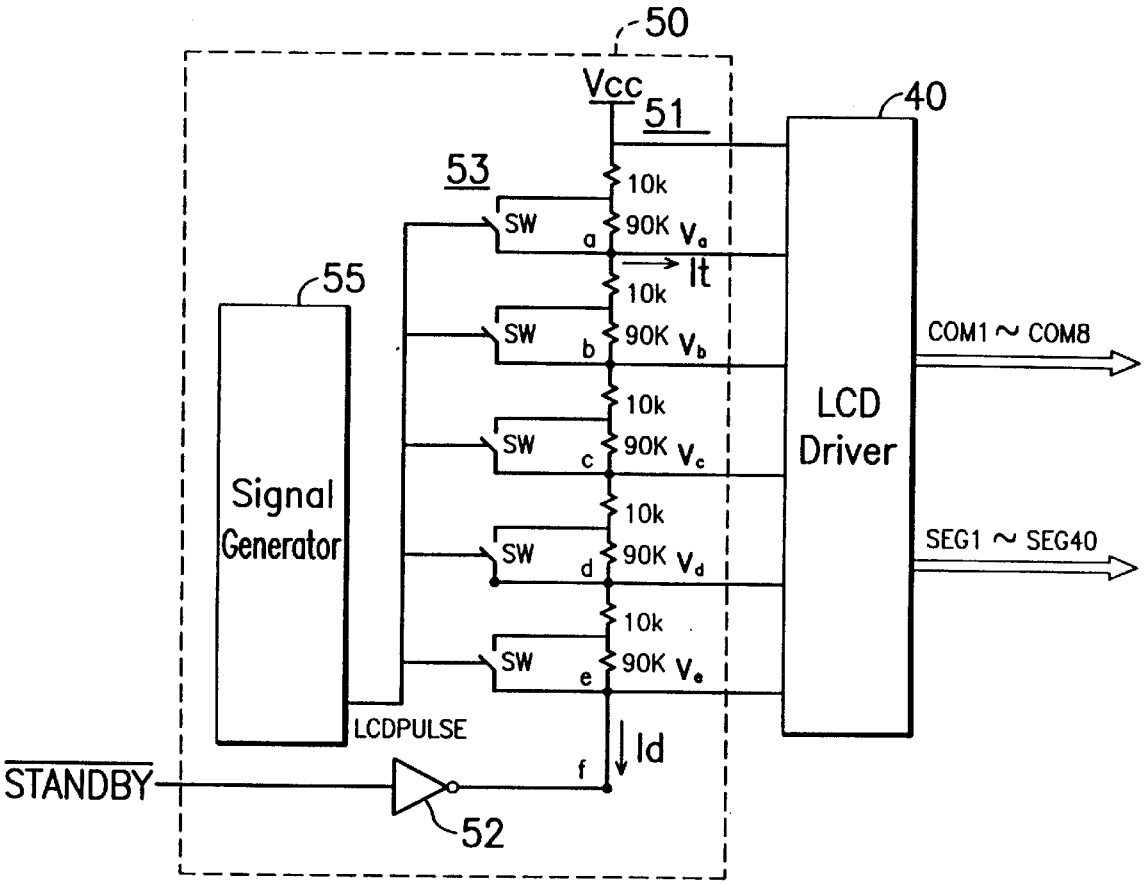
FIG. 5 is a schematic circuit diagram of a further embodiment of the bias voltage generator according to the invention.

Referring to FIG. 5, there is shown a third exemplary embodiment of the bias voltage generator 50 according to the invention. In this embodiment, elements that are identical in structure and function to those in the first exemplary embodiment are labeled with the same numerals and the description thereof will not be repeated.

The third exemplary embodiment differs from the previous ones in that the voltage divider 51 consists of a plurality of pairs of 10 kΩ and 90 kΩ resistors connected in parallel, and the switching circuit 53 consists of a plurality of corresponding switches SW, each being connected across a 100 kΩ equivalent resistor.

When the LCD driving signals are to be switched, the signal generator 55 generates the signal LCDPULSE=1, which causes the switches SW to be closed. As a consequence, the 90 kΩ resistors are nullified and the equivalent resistance between each pair of adjacent nodes is 10 kΩ. The low 10 kΩ resistance allows the bias voltage generator 50 to supply large actuating currents $I_t$ to the LCD driver 40 to actuate the LCD driver 40 to generate the LCD driving signals.

Otherwise, the signal generator 55 will generate the signal LCDPULSE=0, which causes the switches SW to be open, thereby disconnecting the current path therethrough. In this circumstance, the equivalent series resistance between each pair of adjacent nodes is 100 kΩ plus 90 kΩ, which is equal to 100Ω. The high 100 Ω resistance allows the current $I_d$ to be significantly reduced.

It should be noted that each of the three exemplary embodiments described herein includes some form of variable resistance which is switched between a lower resistance value and a higher resistance value in response to the switching signal LCD pulse.

Figure 6:
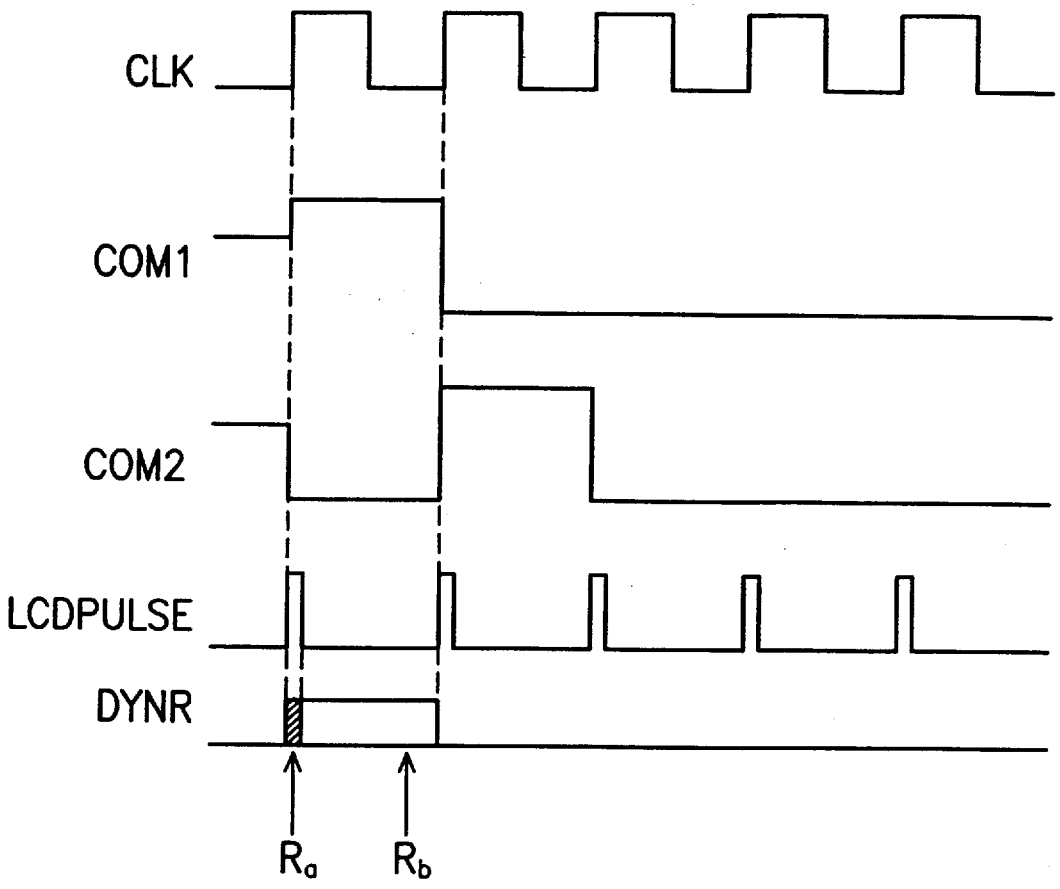
FIG. 6 is waveform diagrams of control signals used in the bias voltage generator according to the invention.

FIG. 6 shows the waveform diagrams of the signals CLK, COM1, COM2, LCDPULSE, and DYNR used in the bias voltage generator 50 according to the invention. The CLK signal is generated by the signal generator 55 with timing based on the system clock signal SYSCK. As shown, when the common signals COM1 and COM2 are to be generated by the LCD driver 40, the signal generator 55 will generate, in synchronism with the common signals, the switching signal LCDPULSE signal, which consists of a train of pulses. This causes the voltage divider 51 to be switched to low resistance, thereby obtaining larger actuating currents $I_t$.

Furthermore, the voltage divider 51 in combination with the switching circuit 53 constitute a dynamic resistor DYNR. During the time the signal generator 55 generates the LCDPULSE signal, switches SW of the switching circuit 53 are closed, providing a current path and allowing the high resistance in the voltage divider 51 to be connected in parallel with the low resistance in the switching circuit 53, equivalently producing a low resistance Ra. For example, in the first exemplary embodiment, Ra=(100×10)/(100+10)= 9.09kΩ.

Otherwise, the switching circuit 53 is open, which causes adjacent nodes to have a high resistance Rb, for example 100 kΩ. This allows the current $I_d$ to be low.

The method of operation of the first exemplary embodiment of the invention includes the following steps: generating a switching signal LCDPULSE; applying a voltage to a voltage divider 51 to set a bias voltage $V_a$, $V_b$, $V_c$, $V_d$, and $V_e$ at each node of a plurality of nodes a, b, c, d, e of the voltage divider 51, wherein the voltage divider 51 includes a plurality of serially connected first resistors (100 kΩ) and wherein each node is located between a corresponding adjacent pair of the first resistors; opening and closing a plurality of serially connected switching units $S_a$, $S_b$, $S_c$, $S_d$, and $S_e$ in response to the switching signal LCDPULSE, wherein each of the switching units includes a switch SW and a second resistor (100 kΩ) and wherein each of the switching units $S_a$, $S_b$, $S_c$, $S_d$, and $S_e$ is connected in parallel with a corresponding one of the first resistors; and connecting each of the second resistors in parallel with the corresponding first resistor when the switching units $S_a$, $S_b$, $S_c$, $S_d$, and $S_e$ are closed.

The method of operation of the second exemplary embodiment of the invention includes the following steps: generating a switching signal LCDPULSE; applying a voltage to a voltage divider 51 to set a bias voltage $V_a$, $V_b$, $V_c$, $V_d$, and $V_e$ at each node of a plurality of nodes a, b, c, d, e of the voltage divider 51, wherein the voltage divider 51 includes a plurality of serially connected divider resistors (100 kΩ) and wherein each node is located between a corresponding adjacent pair of the divider resistors; opening and closing a plurality of serially connected transistor switching units in response to the switching signal LCDPULSE, wherein each of the transistor switching units includes a transistor switch SW and an internal resistance, and wherein each of said plurality of transistor switching units is connected in parallel with a corresponding one of the divider resistors; and connecting each of the internal resistances in parallel with the corresponding divider resistor when the transistor switches SW are closed.

The method of operation of the third exemplary embodiment of the invention includes the following steps: generating a switching signal LCDPULSE; applying a voltage to a voltage divider 51 to set a bias voltage $V_a$, $V_b$, $V_c$, $V_d$, and $V_e$ at each node of a plurality of nodes a, b, c, d, e of the voltage divider 51, wherein the voltage divider 51 includes a plurality of serially connected pairs of first and second resistors (10 kΩ and 90 kΩ, respectively) and a respective node at one end of each said pair of first and second resistors; opening and closing a plurality of serially connected switches SW in response to the switching signal LCDPULSE, wherein each of the switches SW is connected in parallel with a corresponding one of the second resistors; and nullifying the second resistors when the switches are closed.

Figure 7:
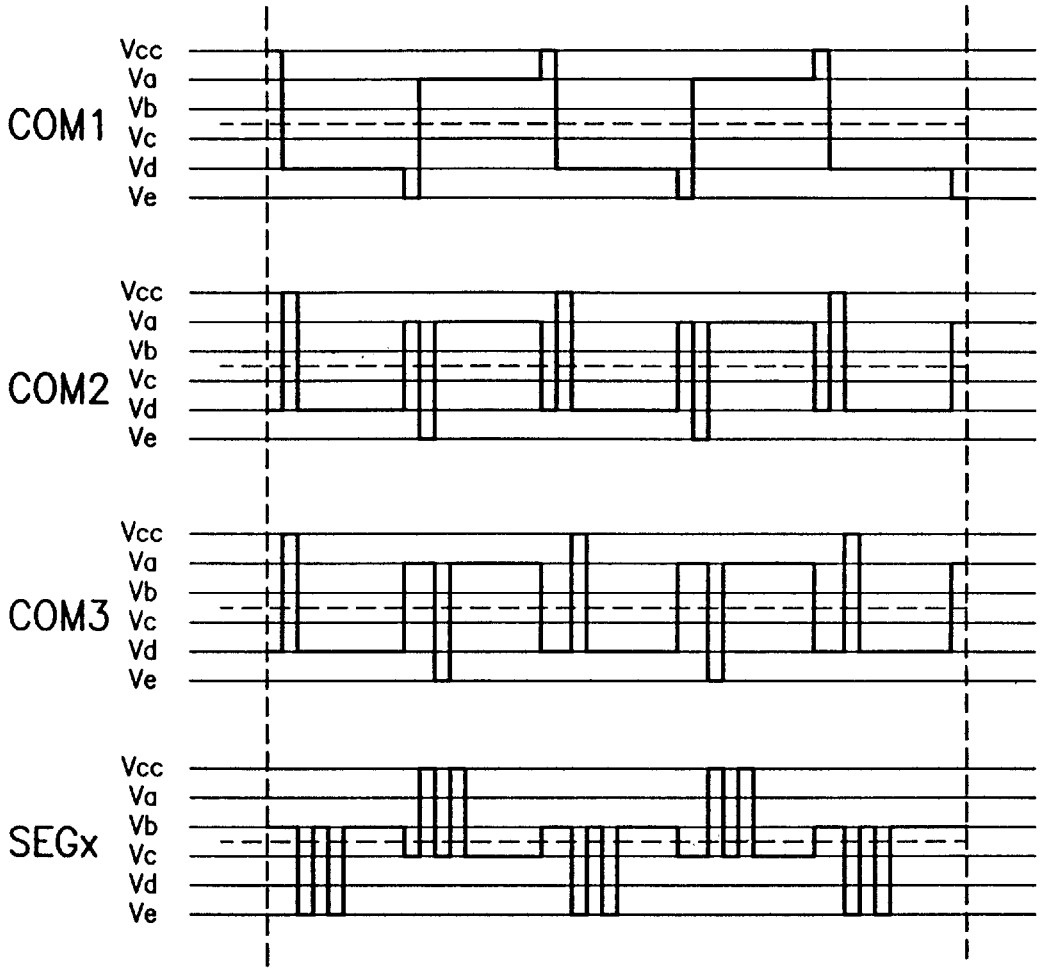
FIG. 7 is waveform diagrams of signals used to drive an LCD.

FIG. 7 shows typical waveforms of the common signals COM1, COM2, and COM3 and segment signals SEGx used to drive the LCD. The LCD driver 40 is driven by the bias voltages $V_a$, $V_b$, $V_c$, $V_d$, and $V_e$ at the nodes a, b, c, d, e. In accordance with the invention, the bias voltage generator is capable of dynamically providing a smaller equivalent resistance between the nodes so as to minimize the occurrence of spike during switching of the LCD driving signals. At other times, the bias voltage generator is capable of providing a greater equivalent resistance between the nodes so as to lower leakage current through the resistors.

The invention has been described above with exemplary preferred embodiments. However, it is to be understood that the scope of the invention is not be limited to the disclosed preferred embodiments. To the contrary, it is intended to cover various modifications and similar arrangements within the scope defined in the following appended claims. The scope of the claims should be accorded the broadest interpretation so as to encompass all such modifications and similar arrangements.

What is claimed is:

1. An apparatus for generating bias voltages for an LCD driver, comprising:

a signal generator for generating a switching signal;

a voltage divider, including a plurality of serially connected pairs of first and second resistors and a respective node at one end of each said pair of first and second resistors;

a switching circuit, including a plurality of switches connected such that each said switch is connected in parallel with a corresponding one of the second resistors;

wherein said switching circuit is responsive to the switching signal to open each of the switches when the switching signal is a logic 0 and to close each of the switches when the switching signal is a logic 1, wherein the second resistors are nullified when the switches are closed, whereby bias voltages are generated at the nodes when a voltage is applied to said voltage divider.

2. An apparatus as claimed in claim 1, wherein the first resistor of each said pair of first and second resistors has a lesser resistance value than the corresponding second resistor of each said pair of first and second resistors.

3. An apparatus as claimed in claim 1, further comprising an LCD driver, wherein the bias voltages enable the LCD driver to generate a plurality of LCD driving signals, wherein the LCD driving signals include a plurality of common signals and a plurality of segment signals.

4. An apparatus as claimed in claim 1, wherein said plurality of serially connected alternating first and second resistors forms a DC current path which has a first end coupled to a voltage source and a second end responsive to a standby signal such that the DC current path has no electrical voltage difference between the first end and the second end when the standby signal has an electrical voltage equal to the voltage source.

5. A method for generating bias voltages for an LCD driver, comprising the steps of:

(a) generating a switching signal;

(b) applying a voltage to a voltage divider to set a bias voltage at each node of a plurality of nodes of the voltage divider, wherein the voltage divider includes a plurality of serially connected pairs of first and second resistors and a respective node at one end of each of said pairs of first and second resistors;

(c) opening and closing a plurality of serially connected switches in response to the switching signal, wherein each of the switches is connected in parallel with a corresponding one of the second resistors, and wherein each of the switches is closed when the switching signal is a logic 1 and each of the switches is opened when the switching signal is a logic 0; and (d) nullifying the second resistors when the switches are closed.

6. A method as claimed in 1, wherein the first resistors have smaller resistance values than the second resistors.

7. An apparatus for generating bias voltages for an LCD driver, comprising:

a signal generator for generating a switching signal;

a voltage divider, including a plurality of serially connected pairs of first and second resistors and a respective node at one end of each said pair of first and second resistors, said plurality of serially connected pairs of first and second resistors forming a DC current path which has a first end coupled to a voltage source and a second end responsive to a standby signal such that the DC current path has no electrical voltage difference between the first end and the second end when the standby signal has an electrical voltage equal to the voltage source;

a switching circuit, including a plurality of switches connected such that each said switch is connected in parallel with a corresponding one of the second resistors;

wherein said switching circuit is responsive to the switching signal to open and close the switches, wherein the second resistors are nullified when the switches are closed, whereby bias voltages are generated at the nodes when a voltage is applied to said voltage divider.

8. An apparatus as claimed in claim 7, wherein the first resistor of each said pair of first and second resistors has a lesser resistance value than the corresponding second resistor of each said pair of first and second resistors.

9. An apparatus as claimed in claim 7, further comprising an LCD driver, wherein the bias voltages enable the LCD driver to generate a plurality of LCD driving signals, wherein the LCD driving signals include a plurality of common signals and a plurality of segment signals.

10. An apparatus as claimed in claim 7, wherein each of the switches is closed when the switching signal is a logic 1 and open when the switching signal is a logic 0.

* * * * *